US008925280B2

(12) United States Patent
Oliver

(10) Patent No.: US 8,925,280 B2
(45) **Date of Patent: *Jan. 6, 2015**

(54) FORM FOR CONSTRUCTING A THROWER'S CIRCLE

(71) Applicant: Sportsfield Specialties, Inc., Delhi, NY (US)

(72) Inventor: Wayne P. Oliver, Delhi, NY (US)

(73) Assignee: Sportsfield Intellectual, LLC, Delhi, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/076,824

(22) Filed: Nov. 11, 2013

(65) Prior Publication Data

US 2014/0130445 A1 May 15, 2014

Related U.S. Application Data

(63) Continuation of application No. 13/481,300, filed on May 25, 2012, now Pat. No. 8,578,678, which is a continuation of application No. 11/135,063, filed on May 23, 2005, now Pat. No. 8,186,684.

(60) Provisional application No. 60/659,376, filed on Mar. 4, 2005.

(51) Int. Cl.

| | |
|---|---|
| ***E04G 21/00*** | (2006.01) |
| ***E04G 23/00*** | (2006.01) |
| ***E04G 11/06*** | (2006.01) |
| ***A63C 19/06*** | (2006.01) |
| ***A63B 71/00*** | (2006.01) |
| ***E02D 27/02*** | (2006.01) |
| ***E02D 27/32*** | (2006.01) |

(52) U.S. Cl.

CPC ..... *E04G 11/062* (2013.01); *A63C 19/06* (2013.01); *A63B 71/00* (2013.01); *E02D 27/02* (2013.01); *E02D 27/32* (2013.01); *A63B 2244/15* (2013.01); *A63B 2244/17* (2013.01)

USPC ..... 52/741.11; 52/741.41; 52/742.14; 405/256; 405/257; 273/398; 473/170; 473/195

(58) Field of Classification Search

USPC ..... 52/19, 20, 21, 741.11, 741.41, 742.14; 405/53, 40, 41, 55, 257, 256, 229; 249/49, 90; 273/441, 108, 398, 400, 273/401, 402; 472/13, 128, 117; 473/185, 473/195, 180, 186, 170

See application file for complete search history.

(56) References Cited

U.S. PATENT DOCUMENTS

| | | | |
|---|---|---|---|
| 823,507 | A | 6/1906 | Carr |
| 1,405,934 | A | 2/1922 | Olson |

(Continued)

OTHER PUBLICATIONS

Non-Final Office Action mailed Sep. 4, 2008, for parent U.S. Appl. No. 11/135,063, filed May 23, 2005.

(Continued)

*Primary Examiner* — Chi Q Nguyen

(74) *Attorney, Agent, or Firm* — Heslin Rothenberg Farley & Mesiti P.C.

(57) ABSTRACT

A form for constructing a thrower's circle includes a pair of half sections. Each half section has an upper surface and a base surface and two full length members and two half length members. The full length members and the half length members are connected together substantially at right angles to form a rectangle with four corners. A corner brace is located in each of the four corners. An inside cross member and an outside cross member extend between the half length members and are generally parallel to the full length members. A pair of semi-circles, each having substantially the same diameter that is larger than the length of the half length members and less than the length of the full length members. Means are provided for securing the half sections together so that the semi-circles form a full circle. Tubes extend from the circle toward the base to drain water from with in the circle.

30 Claims, 7 Drawing Sheets

(56) References Cited

U.S. PATENT DOCUMENTS

| | | | | |
|---|---|---|---|---|
| 1,670,339 | A | | 5/1928 | Butterworth |
| 2,846,570 | A | | 8/1958 | Harling |
| 3,490,769 | A | | 1/1970 | Torbett |
| 4,308,388 | A | | 12/1981 | Petrillo, Jr. et al. |
| 4,308,688 | A | | 1/1982 | Revane |
| 4,428,985 | A | | 1/1984 | Bertolazzi |
| 4,986,025 | A | | 1/1991 | Imperial |
| 5,021,261 | A | | 6/1991 | Bowman |
| 5,586,417 | A | | 12/1996 | Henderson et al. |
| 5,704,159 | A | | 1/1998 | Dreyer et al. |
| 5,743,673 | A | | 4/1998 | Bravo |
| 5,918,411 | A | * | 7/1999 | Hadrava ..... 47/21.1 |
| 5,941,398 | A | | 8/1999 | Harris |
| 6,035,581 | A | | 3/2000 | McCoy |
| 7,390,142 | B2 | | 6/2008 | O'Brien |
| 8,186,684 | B2 | | 5/2012 | Oliver |
| 8,578,678 | B2 | | 11/2013 | Oliver |

OTHER PUBLICATIONS

Non-Final Office Action mailed Aug. 6, 2009, for parent U.S. Appl. No. 11/135,063, filed May 23, 2005.

Restriction Requirement mailed Mar. 2, 2010, for parent U.S. Appl. No. 11/135,063, filed May 23, 2005.

Final Office Action mailed Jul. 21, 2010, for parent U.S. Appl. No. 11/135,063, filed May 23, 2005.

Advisory Action mailed Nov. 22, 2010, for parent U.S. Appl. No. 11/135,063, filed May 23, 2005.

"Throwing Equipment," M-F Athletic Company, Cranston, RI, 2-pages, 2005.

"Circles/Toeboards," Gill Athletics, Champaign, IL, 3-pages, 2005.

"Throwing Surface Equipment," AAA Aluminum Athletic Equipment, Royersford, PA, 2-pages, 2004-2005.

"Throwing Rings," UCS Corp., Lincolnton, NC, 2-pages, 2005.

* cited by examiner

FORM FOR CONSTRUCTING A THROWER'S CIRCLE

CROSS-REFERENCE TO RELATED APPLICATION

This patent application is a continuation application of U.S. patent application Ser. No. 13/481,300, filed May 25, 2012, entitled "Methods For Installing A Thrower's Circle" which issued as U.S. Pat. No. 8,578,678, which is a continuation application of U.S. patent application Ser. No. 11/135,063, filed May 23, 2005, entitled "Form For Constructing A Thrower's Circle" which issued as U.S. Pat. No. 8,186,684, which claims the benefit of an earlier filing date under 35 USC 119(e) of a Provisional Patent Application Ser. No. 60/659,376, filed in the United States Patent and Trademark Office on Mar. 4, 2005 and entitled "Forms for Constructing Thrower's Circle."

BACKGROUND OF THE INVENTION

1. Field of the Invention

This invention relates to a form for constructing player's circle as used in field sports and, more specifically, for a form for constructing a circle for the throwing of hammers and shot put and a form for throwing discus.

2. Prior Art

In the field of sports, the throwing of either hammer or shot put or throwing discus, the player throws from a circular area in a specific location. In the past, such circular areas for throwing have been constructed in parts. Only too frequently, the result was an inaccurate product. Of even greater significance, such construction was labor intensive and thus time consuming and worst of all, expensive.

In accordance with this invention, a form for use in constructing such thrower's circles is prefabricated under manufacturing conditions thereby assuring accuracy and economy. The form can be readily transported and installed to produce an accurate circle for throwing that is permanent and economical.

OBJECTS

The objects of this invention as follows:

1. To provide a form for constructing a player's circle that is prefabricated under manufacturing conditions to provide accuracy and uniformity to produce a highly accurate player's circle.
2. To provide a form for constructing a players circle which is economical to construct while assuring high quality.
3. To provide a form for constructing a players circle which is permanent and durable.
4. To provide a form for constructing a player's circle which form can be readily transported to a construction site.

These and other objects will be apparent to those skilled in the art by reading the detailed description of the invention set forth hereinafter.

SUMMARY OF THE INVENTION

A form for constructing a thrower's circle includes a pair of half sections. Each half section has an upper surface and a base surface. A pair of semi-circles each with the same diameter are mounted on the upper surface of the half section. Each circle has the same diameter. A means are also provided for securing the half sections together with the two semi-circles forming a full circle.

BRIEF DESCRIPTION OF THE NUMERALS

Figure 1:
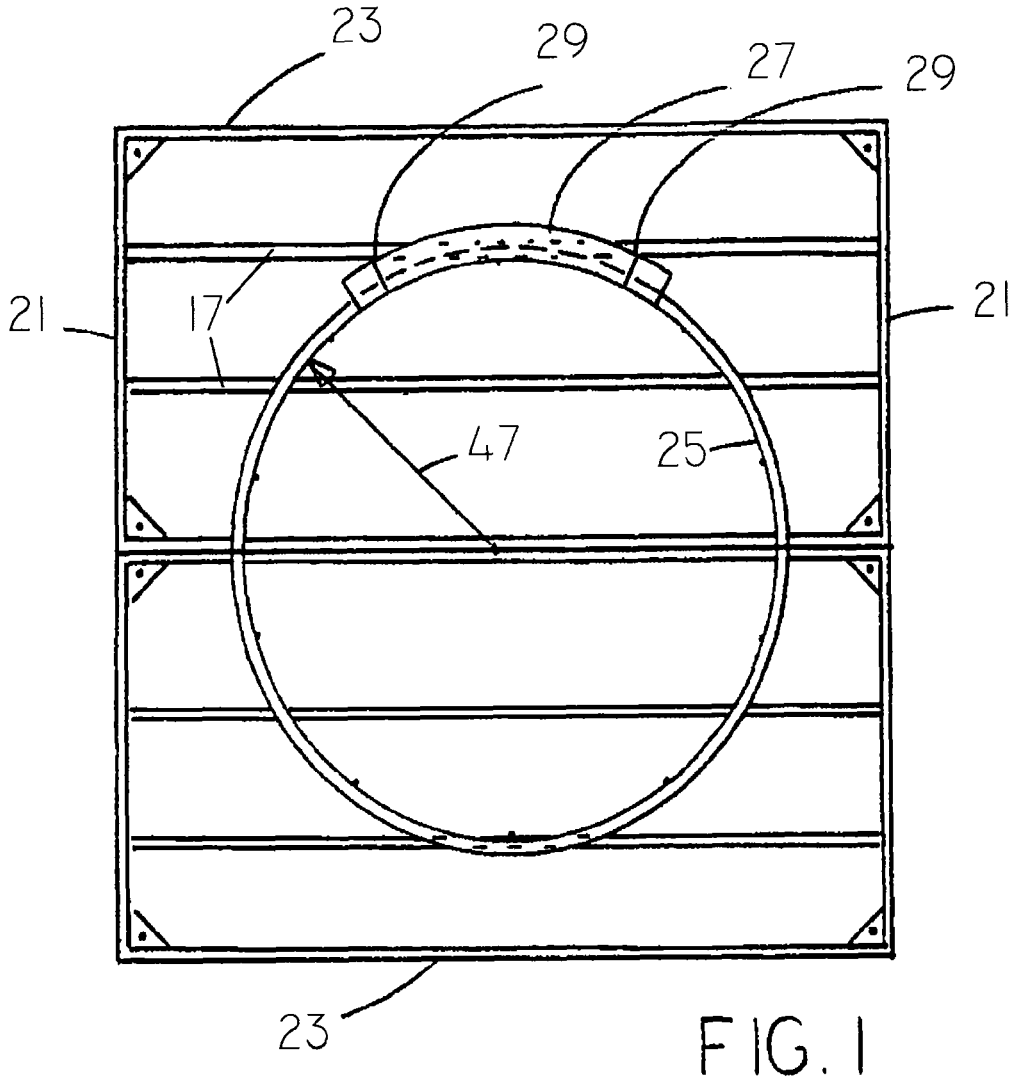
FIG. 1 is a plan view of the form for constructing a players circle for throwing hammer and shot put with the form fully assembled.
Figure 2:
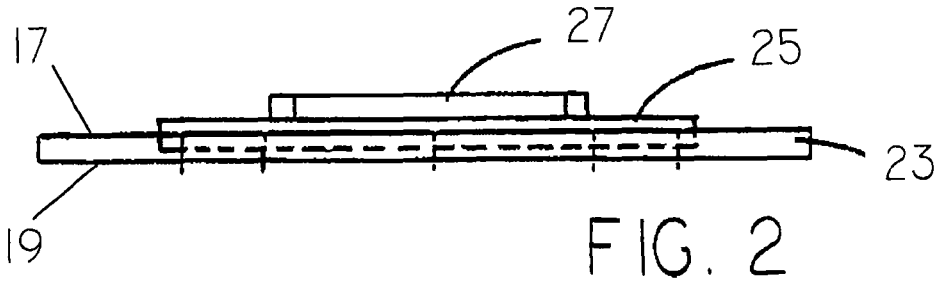
FIG. 2 is a side elevation of the form shown in FIG. 1.

17 Upper Surface
19 Base Surface
21 side members\
23 outer members
25 circle (shot put)
27 toe board
29 marks
31 bolts
33 nuts
35 half sections
37 half side members
39 full side members
41 corner
43 brace
45 semi-circles
47 diameter
49 inside full members
50 outside full members
51 circumference
53 two cross members (Shot Put)
55 inside cross members (Shot Put)
57 outside cross members (Shot Put)
59 tubes
61 circle (Discus)
63 outside cross member (Discus)
65 inside cross member (Discus)
67 Notches

DETAILED DESCRIPTION OF THE PREFERRED EMBODIMENT

The form for constructing a circle for throwing a hammer and shot put are shown in FIG. 1 through FIG. 4. The form for constructing a circle for throwing discus is shown in FIG. 5 through FIG. 8. Both forms are very similar and are constructed in the same manner. The differences between the two forms are dictated by the requirements for a circle for throwing hammer and shot put and a circle for throwing discus. The form for constructing a circle for showing hammer and shot put will be described first but the numerals used as to describe that form will also used for the form for constructing a circle for throwing discus. The form for constructing a circle for throwing discus will be described after the form for throwing hammer and shot put but only to reflect the differences. Parts which are different will be assigned a different numeral.

The installation of the form is both fast and simple. Once the form is completely assembled, as discussed hereinafter, an excavation of the area is performed and is filled with crushed stone. The form is placed on the crushed stone in a level position. Cement is placed around and in the form up to the base of the circle. Once the cement has dried, dirt is placed over the cement only outside of the circle up to the top edge of the circle. The cement floor in the circle is shaped with a slight rise in the center of the circle to cause water to flow toward the edges of the circle. Once constructed, the circle is recessed within the surrounding ground.

Form for Hammer and Shot Put

Referring now to FIG. 1, the form is shown that is used to construct a circle for throwing hammer and shot put (hereinafter "Shot Put Form"). The Shot Put Form, when assembled, has a upper surface 17 and a lower surface 19 and is essentially a square having two side members 21 and two outer members 23. The circle 25, for use by the player, is mounted generally in the center of the square. The two outer members 23 and the side members 21 are essentially the same length.

The circle 25 includes a toe board 27 which is located toward one outer member 23 generally equally-spaced between two side members 21. The toe board 27 is constructed with a length suitable for more inexperienced players, most especially high school students and also has marks 29 on it to indicate the length of the toe board 27 for more advanced players, namely college students. The toe board 27 is preferably secured to the circle 25 by bolts 31 and nuts 33.

Figure 4:
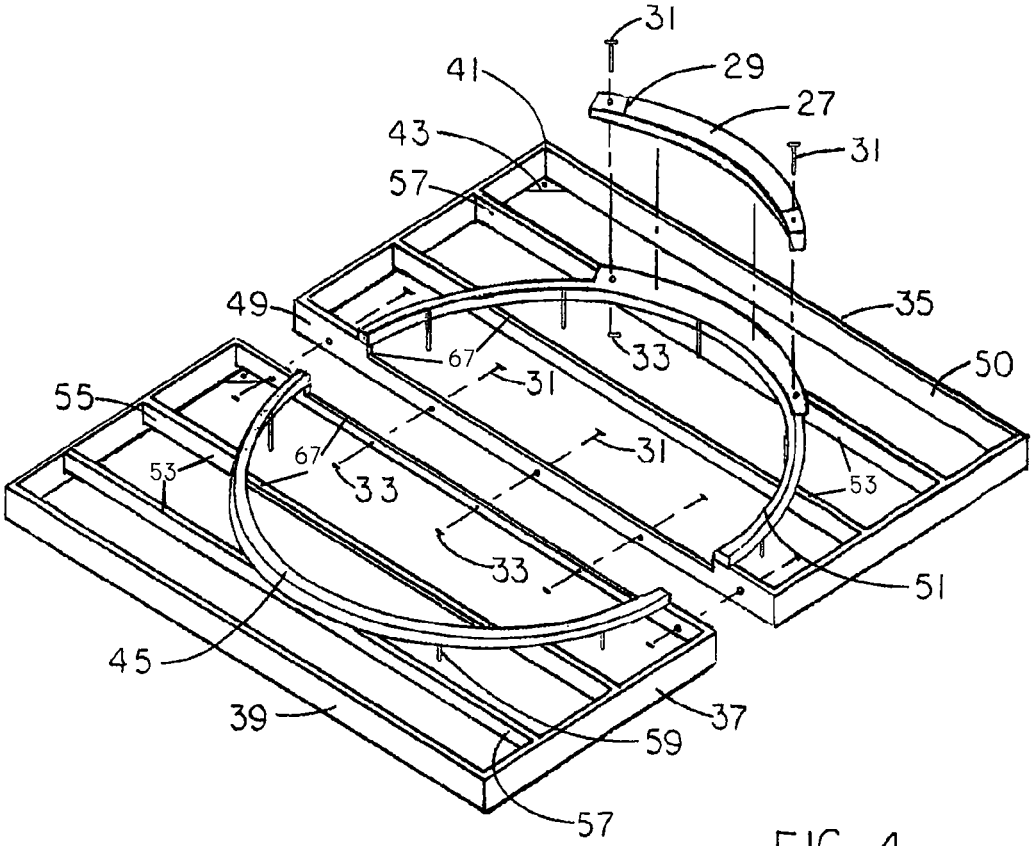
FIG. 4 is an exploded perspective view of the form shown in FIG. 3 showing the three manufactured components of the form prior to being assembled.
Figure 5:
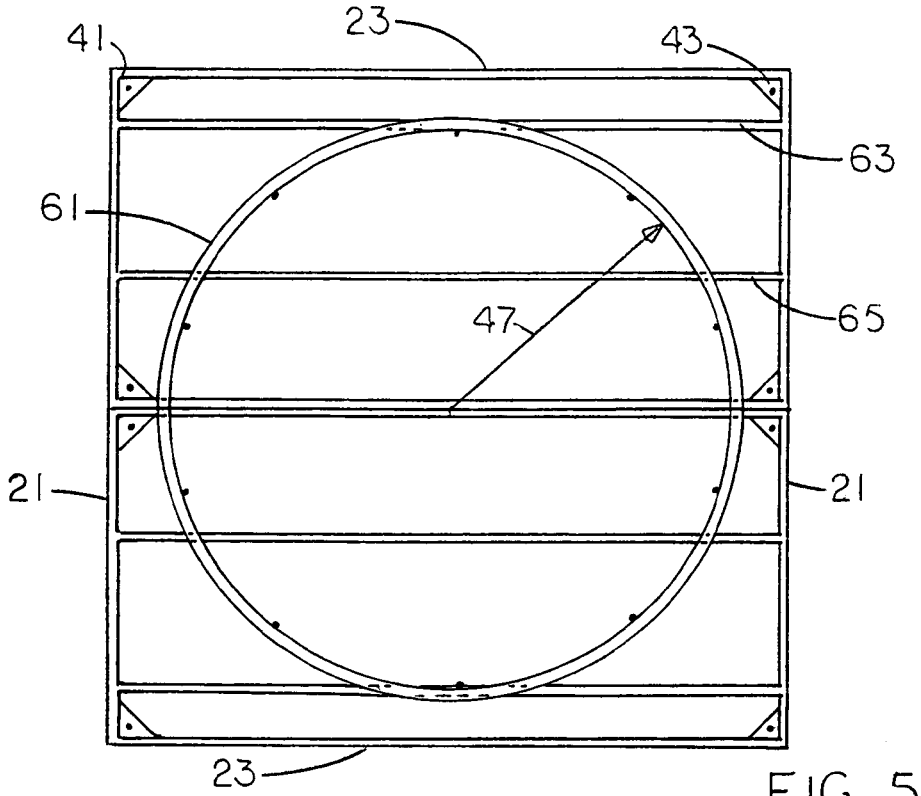
FIG. 5 is a plan view of the form for a player's circle for throwing discus with the form fully assembled on site.
Figure 6:
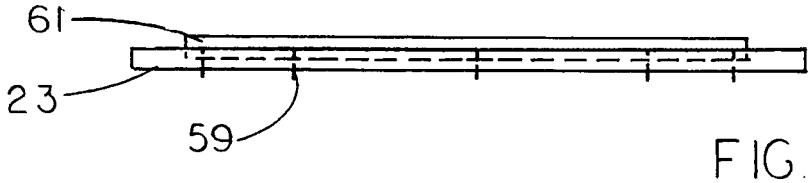
FIG. 6 is a side elevation of the form shown in FIG. 5.
Figure 7:
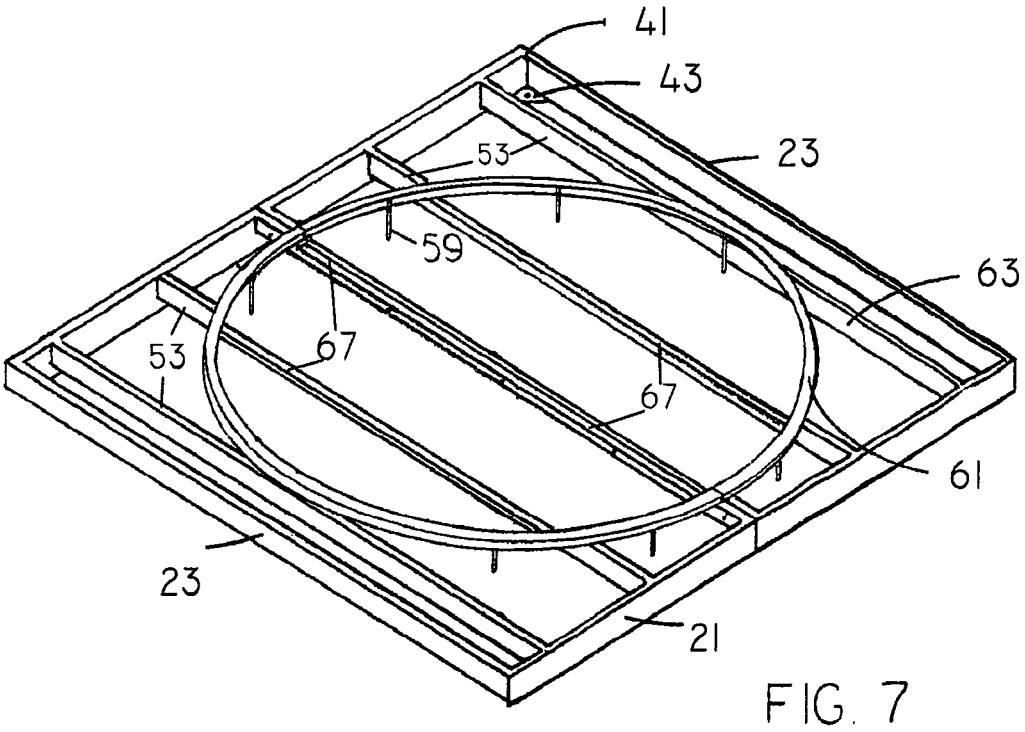
FIG. 7 is a perspective view of the form for throwing discus fully assembled.
Figure 8:
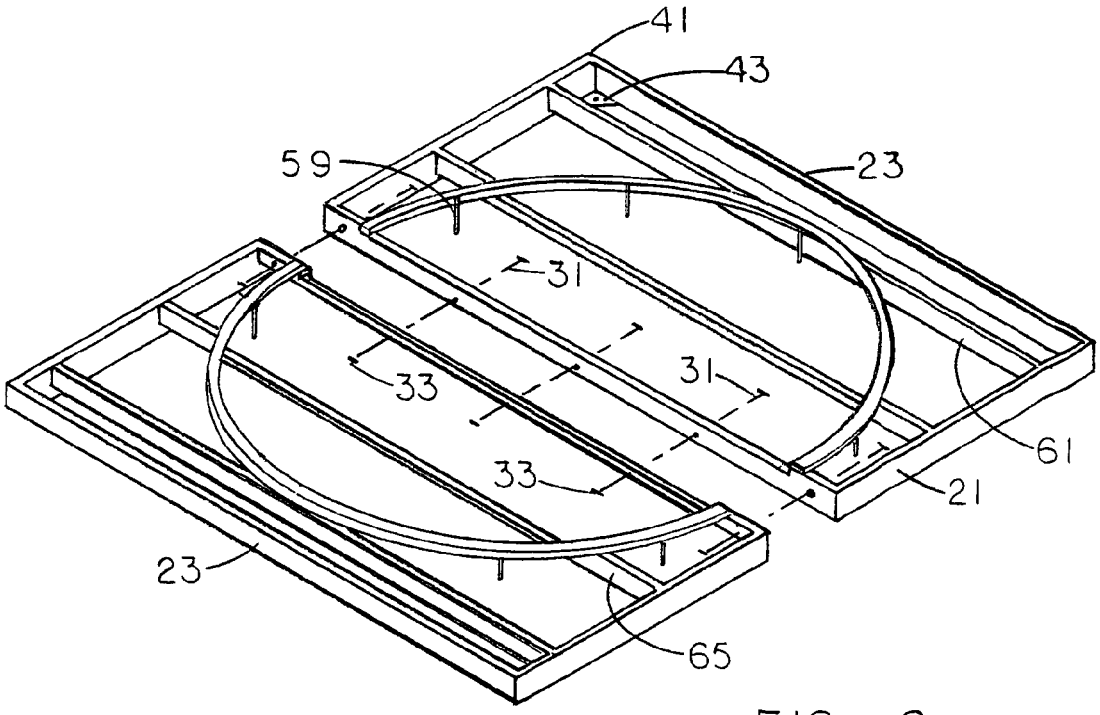
FIG. 8 is an exploded perspective view of the form shown in FIG. 7 showing the two manufactured components of the form prior to being assembled on site.
Figure 9:
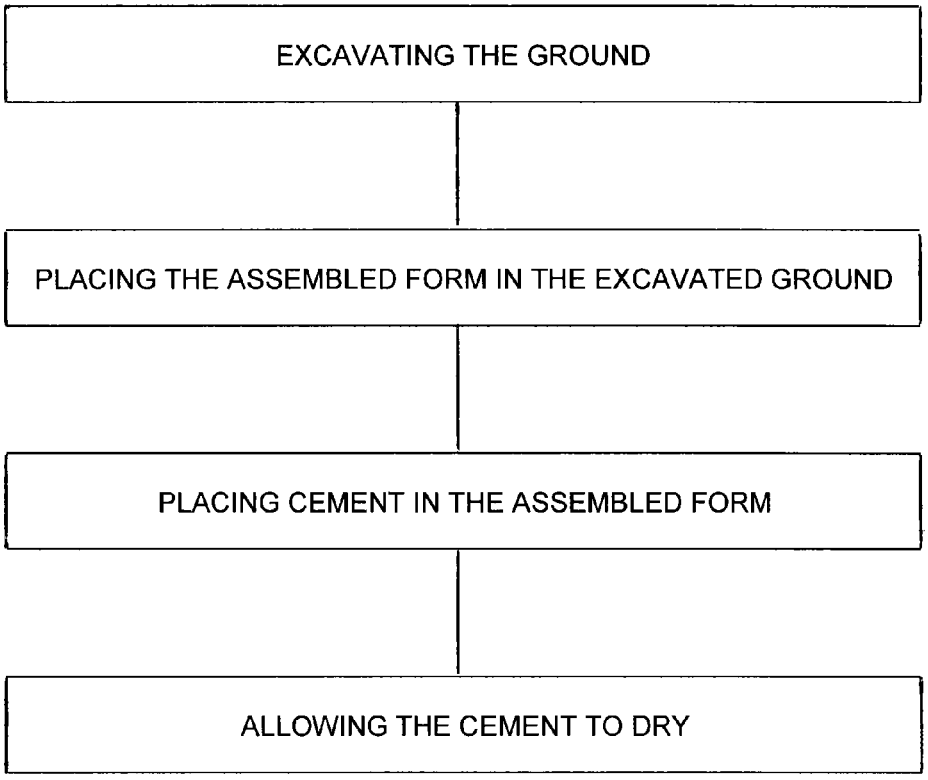
FIG. 9 is a flowchart of one embodiment of a method for installing a thrower's circle in the ground of an athletic field in accordance with aspects of the present disclosure.

Referring now to FIG. 4, it can be seen that the Shot Put Form is preferably produced in a pair of half sections 35. Each of the two half sections 35 are the same except for the toe board 27.

Each half section 35 has two half side members 37 and two full side members 39, both of the two side members 37 are also outer members 23 of the assembled Shot Put Form. Each half side member 37 is substantially one-half the length of a full side members 39. The half side members 37 are secured to the full side members 39 substantially at right angles. At each corner 41 of each half section 35, a brace 43 is installed to strengthen the corners 41.

A pair of semi-circles 45 are placed on the pair of half sections 35. Each semicircle 45 has a diameter 47 and the diameter 47 of each semi-circle 45 is placed along a full side member 39 generally equally distant between the half side members 37. The full side members 39 where the diameter 49 of the semi circles 45 is located are inside full members 49 and the inside full members 49 of the pair of half sections 35 are placed together. The opposite full side members 39 are the outside full members 50. When the two half sections 35 are together with the inside full members 49 abutting one another, the two semi circles 45 form the circle 25. The two half sections 35 form a square. The circle 25 has a circumference 51 and is generally located in the center of the Shot Put Form.

Each half section 35 has two cross members 53 which are parallel with the full side members 39, and extend from the half members 35. The two cross members 53, namely an inside cross member 55 and an outside cross member 57 are generally evenly spaced between the inside full members 49 and the outer members 23. The circle 25 for the Shot Put Form is supported at two points by each of the inside cross members 55 and at one point by each of the outside cross members 57 where the circumference of the circle 25 just extends over the outside cross member 57.

Figure 3:
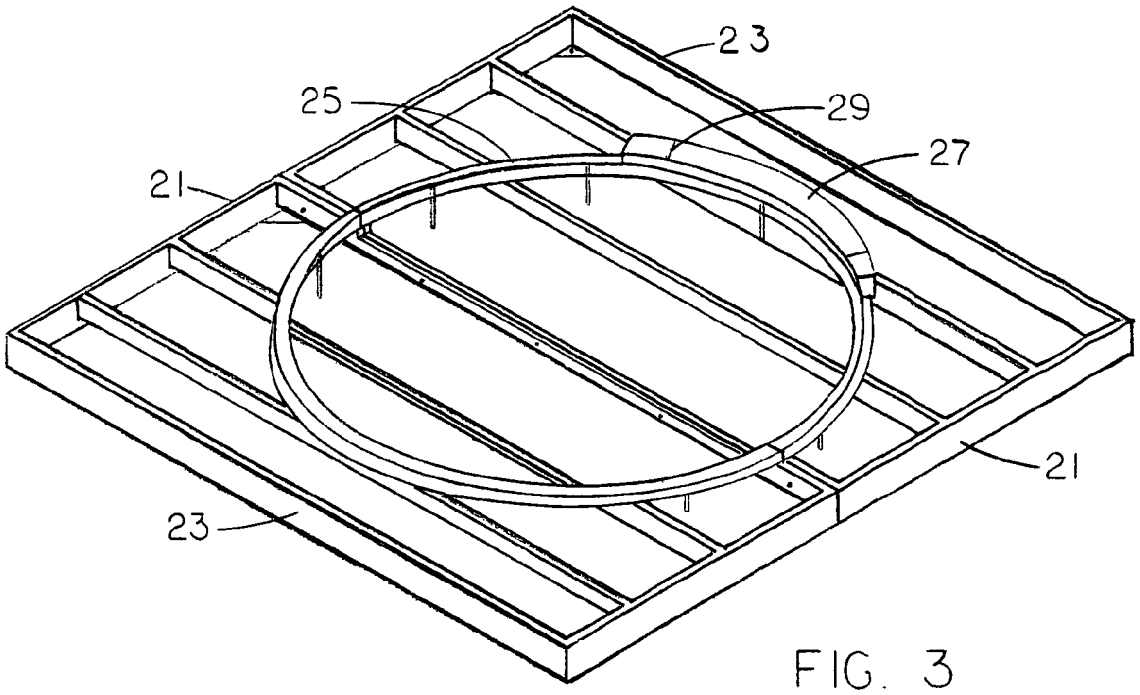
FIG. 3 is a perspective view of the form for throwing hammer and shot put fully assembled.

As shown in FIG. 3 and FIG. 4, a plurality of tubes 59, that are vertically oriented, are located about and secured to the inside of the circumference 51 of the circle 25. These tubes 59 provide drainage from within the circle 25. The tubes 59 direct water down to the crushed stone. As previously discussed, the cement in the circle 25 is raised slightly higher in the center to cause water to drain to the circumference 51 the circle 25 where the tubes 59 are located. In the upper surface 17, notches 67 may be cut into the inside full members 49 and the two cross members 53. The notches 67, which are used to hold Rebar, if desired, is inserted into the notches 67. Rebar, however, is not actually required. The notches 67 are aligned with one another generally parallel to the half side members 37.

Form for Discus

The form that is used to construct the circle 61 for throwing a discus (hereinafter "Discus Form") is basically constructed in the same manner as the Shot Put Form.

The Discus Form is shown in FIG. 5 through FIG. 8 and does not include a toe board 27. The circle 61 of the Discus Form is larger that the circle 25 of the Shot Put Form. Due to the size of the circle of the Discus Form 61, an outside cross member 53 is placed closer to the outer member 23. Each inside cross member 65 is located substantially midway between the inside full member 49 and the outside cross member 53. Discus Forms are assembled and installed in the same manner as are Shot Put Forms. Notches 67 for Rebar may be added in the same manner as with the shot-Put Form. The notches 67 are aligned with the side members and are placed in the inside full members 49, the outside cross members 63 and the inside cross members 65.

It is to be understood that the drawings and the description are in all cases to be interpreted as merely illustrative of the principles of the invention rather that as limiting the same in any one way since it is contemplated that various changes may be made in various elements to achieve like results without departing from the spirit of the invention or scope of the appended claims.

The invention claimed is:

1. A form for constructing a thrower's circle comprising:

a plurality of sections, each of said sections comprising a plurality of members;

a plurality of arcuate portions;

wherein when the plurality of sections is assembled together, the plurality of arcuate portions together forms a full circle defining a circular area dimensioned for a player throwing from the circular area at least one of a hammer, a shot put, and a discus, and a first portion of the plurality of members being disposed outside the full circle and a second portion of the plurality of members being disposed inside the full circle.

2. The form of claim 1 wherein each plurality of sections comprises four right angles.

3. The form of claim 1 wherein when the plurality of sections are assembled together, the form defines a square with the full circle disposed inside the square.

4. The form of claim 1 wherein each of the plurality of sections comprises a plurality of side members.

5. The form of claim 4 wherein each of the plurality of sections comprises at least one cross member.

6. The form of claim 1 further comprising a plurality of tubes operable for drainage from the circular area.

7. The form of claim 6 wherein at least portions of the plurality of tubes extend generally vertically.

8. The form of claim 1 further comprising a toe bar mountable on at least one of the arcuate portions.

9. The form of claim 1 wherein an upper surface of the full circle is disposed above the plurality of sections.

10. The form of claim 1 wherein the plurality of sections comprises a pair of half sections, and the plurality of arcuate portions comprises a pair of semi-circles.

11. The form of claim 1 further comprising means for securing the plurality of sections together.

12. A method for forming a thrower's circle, the method comprising:

assembling a form comprising:

a plurality of sections;

a plurality of arcuate portions;

wherein when the plurality of sections is assembled together, the plurality of arcuate portions together forms a full circle defining a circular area dimensioned for a player throwing from the circular area at least one of a hammer, a shot put, and a discus, and a first portion of the plurality of sections being disposed outside the full circle and a second portion of the plurality of sections being disposed inside the full circle;

installing the assembled form in the ground; and wherein the installing comprises excavating the ground, placing the assembled form in the excavated ground, placing cement in the assembled form, and allowing the cement to dry.

13. The method of claim 12 wherein the assembling the form defines a square with the full circle disposed inside the square.

14. The method of claim 12 wherein the placing cement in the assembled form comprises placing the cement in the assembled form in the portion of the plurality of sections disposed outside the full circle and the portion of the plurality of sections disposed inside the full circle.

15. The method of claim 12 wherein a surface within the circle is recessed relative to the top edge of the circle.

16. The method of claim 12 further comprising shaping a surface in the circle at a slight rise in the center of the circle to cause water to flow towards the circle.

17. The method of claim 12 further comprising filing the excavated ground with a crushed material.

18. The method of claim 12 further comprising providing passageways operable for drainage from the circular area.

19. The method of claim 12 further comprising attaching a toe bar to the assembled form.

20. A form for constructing a thrower's circle comprising:

a plurality of sections;

a plurality of arcuate portions;

wherein when the plurality of sections is assembled together, the plurality of arcuate portions together forms a full circle defining a circular area dimensioned for a player throwing from the circular area at least one of a hammer, a shot put, and a discus, and a first portion of the plurality of sections being disposed outside the full circle and a second portion of the plurality of sections being disposed inside the full circle; and wherein an upper surface of the full circle is disposed above the plurality of sections.

21. The form of claim 20 wherein each of the plurality of sections comprises at least one cross member.

22. The form of claim 20 further comprising a plurality of tubes operable for drainage from the circular area.

23. The form of claim 22 wherein at least portions of the plurality of tubes extend generally vertically.

24. The form of claim 20 further comprising a toe bar mountable on at least one of the arcuate portions.

25. The form of claim 20 further comprising means for securing the plurality of sections together.

26. A method for forming a thrower's circle, the method comprising:

assembling the form of claim 20; and installing the assembled form in the ground.

27. The method of claim 26 wherein the installing comprises excavating the ground, placing the assembled form in the excavated ground, and placing cement in the assembled form.

28. The method of claim 26 further comprising shaping a surface in the circle at a slight rise in the center of the circle to cause water to flow towards the circle.

29. The method of claim 26 further comprising providing passageways operable for drainage from the circular area.

30. The method of claim 26 further comprising attaching a toe bar to the assembled form.

* * * * *